US007121760B1

(12) United States Patent
Curry, Jr.

(10) Patent No.: US 7,121,760 B1
(45) Date of Patent: Oct. 17, 2006

(54) METHOD AND APPARATUS FOR DEFLATING TIRES OF A TRAILING VEHICLE

(76) Inventor: Joseph Edward Curry, Jr., 21711 Roseville, Spring, TX (US) 77388

( * ) Notice: Subject to any disclaimer, the term of this patent is extended or adjusted under 35 U.S.C. 154(b) by 0 days.

(21) Appl. No.: 11/202,729

(22) Filed: Aug. 12, 2005

(51) Int. Cl.
*E01F 13/12* (2006.01)

(52) U.S. Cl. ..... 404/6; 404/6

(58) Field of Classification Search ..... 404/6–11; 256/1, 13.1
See application file for complete search history.

(56) References Cited

U.S. PATENT DOCUMENTS

| | | | | |
|---|---|---|---|---|
| 3,652,059 | A | 3/1972 | Groblebe | 256/1 |
| 5,330,285 | A * | 7/1994 | Greves et al. | 404/6 |
| 5,452,962 | A | 9/1995 | Greves | 404/6 |
| 5,482,397 | A | 1/1996 | Soleau | 404/6 |
| 5,536,109 | A | 7/1996 | Lowndes | 404/6 |
| 5,611,408 | A | 3/1997 | Abukhader | 180/287 |
| 5,704,445 | A | 1/1998 | Jones | 180/287 |
| 5,820,293 | A * | 10/1998 | Groen et al. | 404/6 |
| 5,839,849 | A | 11/1998 | Pacholok et al. | 404/6 |
| 5,904,443 | A | 5/1999 | Soleau | 404/6 |
| 6,045,293 | A | 4/2000 | Dickenson | 404/6 |
| 6,224,291 | B1 | 5/2001 | Mateychuk | 404/6 |
| 6,312,189 | B1 | 11/2001 | Marphetia | 404/6 |
| 6,357,961 | B1 | 3/2002 | Marphetia | 404/6 |
| 6,551,013 | B1 | 4/2003 | Blair | 404/6 |
| 6,623,205 | B1 | 9/2003 | Ramirez | 404/6 |
| 6,758,628 | B1 * | 7/2004 | Curry, Jr. | 404/6 |
| 2005/0244223 | A1 * | 11/2005 | Shackelford et al. | 404/6 |

* cited by examiner

*Primary Examiner*—Raymond Addie
(74) *Attorney, Agent, or Firm*—Russell J. Egan

(57) ABSTRACT

A tire deflation is deployed from a leading vehicle to cause deflation of the tires of a trailing vehicle. The tire deflation device has two primary components a deployable member, with a plurality of tire piercing spikes mounted thereon, and a launch assembly designed to deposit the deployable member on a road surface in proper position for the at least one of the tires of a trailing vehicle to expose at least some of the spikes which penetrate and deflate the tires, the remaining spikes being released in a safe manner.

14 Claims, 4 Drawing Sheets

METHOD AND APPARATUS FOR DEFLATING TIRES OF A TRAILING VEHICLE

BACKGROUND OF THE INVENTION

1. The Field of the Invention

The present invention an improvement in my previous tire deflating apparatus deployed from a vehicle and, in particular, the improved device is rendered harmless once a single vehicle passes over it.

2. The Prior Art

There seems to be an unfortunate increase in the instances of the police becoming involved in high speed chases of vehicles which have been involved in some sort of illegal activity. The chases are extremely dangerous and have resulted in a great many fatalities, usually of innocent parties. A large number of schemes have been proposed for causing the deflation of the tires of the fleeing vehicle, many of these require depositing spiked strips ahead of the fleeing vehicle and then hoping that the driver of the fleeing vehicle will take a certain route leading to the spiked strips and will not take any evasive action to avoid the spiked strips while on this route.

A major problem with most spiked strips is the danger they pose after deployment, particularly after the target vehicle has been stopped. Another major problem with vehicle mounted spike strip deployment devices is the amount of room they take up in the already crowded front seat of a patrol car. The present invention addresses and overcomes both of these major problems.

U.S. Pat. No. 3,652,059 to Groblebe shows a spike strip with hollow tubes on the spikes which penetrate and stay with a tire.

U.S. Pat. No. 5,330,285 to Greves et al shows a spike strip having a triangular section with spikes arranged along each side to assure penetration of a tire by a spike regardless of how the strip lands on the road surface.

U.S. Pat. No. 5,452,962 to Greves et al is similar to the above discussed patent.

U.S. Pat. No. 5,482,397 to Soleau shows spikes with supports mounted on a base plate. The spike penetrates a tire and is torn from the base plate together with its support.

U.S. Pat. No. 5,536,109 to Lowndes discloses a device to be deployed in advance of the car to be stopped. It combines spike strips, similar to those currently in use, with an apparatus to deploy the spiked strips, which have hollow spikes to increase the rate of deflation.

U.S. Pat. No. 5,611,408 to Abukhader is somewhat similar to the above-mentioned Pacholok et al patent. It is distinguished by the fact that the spikes are hollow to assure deflation of the punctured tire. It would have the same difficulties as the Pacholok device.

U.S. Pat. No. 5,704,445 to Jones discloses hollow spikes projecting from a base. This device is to be used with parked cars, placed by hand on either side of a tire of the car to be disabled, to prevent the car from being driven off.

U.S. Pat. No. 5,839,849 to Pacholok et al discloses a device which is fired forward from a trailing vehicle. The device opens to deploy spikes against the tires of the lead vehicle. There would appear to be an inherent problem with this type of device. If there is a miss, then there is a substantial possibility causing damage to the trailing car's tires.

U.S. Pat. No. 5,904,443 to Soleau shows a tire deflating device in which the spikes are explosively propelled into the tire. It seems that this device would be a hazard to those handling it.

U.S. Pat. No. 6,045,293 to Dickenson shows a spike strip having break-away spikes which stay with the tire once the spike penetrates therein.

U.S. Pat. No. 6,224,291 to Mateychuk shows a tire deflating device having break away spikes.

U.S. Pat. No. 6,312,189 to Marphetia shows spikes held in a plate by resilient means and pulled therefrom when engaged in a tire.

U.S. Pat. No. 6,357,961 to Marphetia shows a complex assembly for holding spikes in a base. The base has apertures and an insert received in each aperture has arms which close about the base of the spike, both the spike and the insert being removed from the aperture when the spike engages a tire.

U.S. Pat. No. 6,551,013 to Blair shows spike strips removeably held on a base plate by hook and loop (VELCRO) type material.

U.S. Pat. No. 6,623,205 to Ramirez shows spikes which are freed from the base plate when they engage a tire.

SUMMARY OF THE INVENTION

The present invention is designed to be deployed from a leading vehicle to cause deflation of the tires of a trailing vehicle. The subject invention has two primary components: a deployable base member, with a plurality of tire piercing spikes freely mounted thereon, and a launch assembly designed to deposit the base member on a road surface in proper position to cause the deflation of the tires of a trailing vehicle by penetration of at least one tire by at least one spike, with the remaining spikes being rendered harmless. The base member is shattered by a tire passing over it with at least some of the spikes penetrating and deflating the tire while the remaining spikes are rendered harmless.

BRIEF DESCRIPTION OF THE DRAWING

The present invention will now be described, by way of example, with reference to the accompanying drawings, in which.

DETAILED DESCRIPTION OF THE INVENTION

The present invention is intended for use in deflating the tires of a fleeing vehicle, usually a vehicle involved in criminal activity provoking police action in attempting to apprehend the driver of the fleeing vehicle. The subject invention is mounted on a police vehicle beneath and to the rear of the chassis, in the general area beneath the trunk (see FIGS. 6 and 7). The subject invention should not adversely affect the road clearance of the vehicle nor should it project beyond the vehicle's rear bumper. Most importantly, the operating mechanism for this invention does not take up much space in the driver compartment of the vehicle and, once deployed, does not pose a traffic hazard for vehicles other than the target vehicle.

Figure 6:
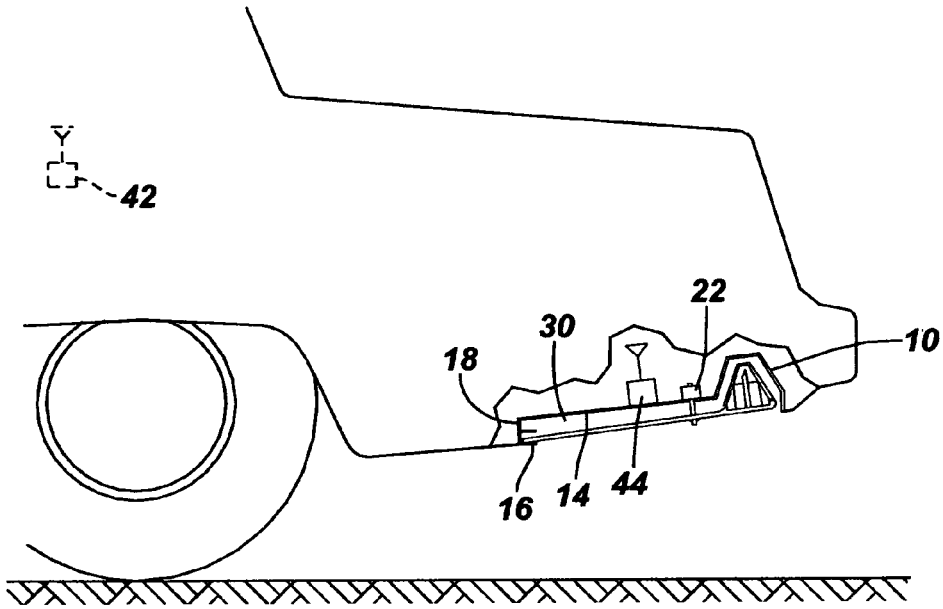
FIG. 6 is a diagrammatic side elevation showing the subject invention, in a stored condition, mounted on a police vehicle.
Figure 7:
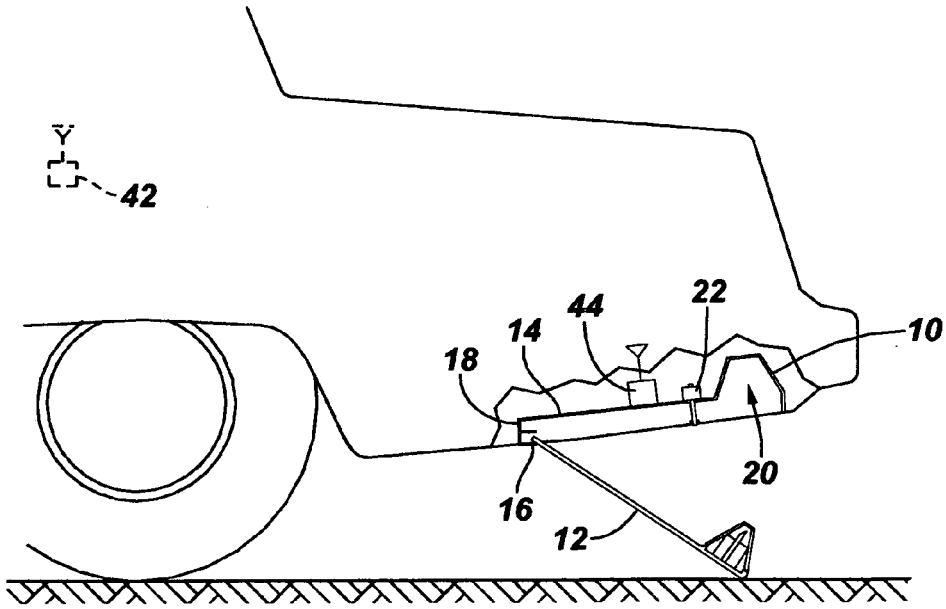
FIG. 7 is a diagrammatic side view, similar to FIG. 6, showing the subject invention in a deploying condition.

The subject invention has two main components, the housing assembly 10 and the tire deflating assembly 12. The housing assembly 10 is mounted on a vehicle, as shown in FIGS. 6 and 7. It has a generally rectangular upper plate 14 with a flange 16 depending from the leading edge 18 and a downwardly directed recess 20 toward the opposite trailing edge. The upper plate 14 is provided with latching means 22. The deflating assembly 12 has a generally rectangular lower or drop plate 24 with a trapezoidal shaped trailing edge 26 and a leading edge 28 engaging the flange 16 to hold in the housing assembly 10. The latching means 22 engages the drop plate in the area of the training edge. The upper plate 14 and the lower plate 24 form a generally hollow compartment 30. The trapezoidal shaped edge 26 encloses a plurality of hollow spikes 32. The hollow spikes 32 are held upright between two members 34 and 36. A third similar member 38 extends along and engages the tops of the spikes 34. These members 34, 36, and 38 are preferably made of a resilient material. The trapezoidal shaped edge 26 is attached to the rectangular base plate 24 along a frangible joint 40, here shown as a grooved, thin, breakable section. Each hollow spike 32 rests freely on the lower or drop plate 24 in order to be rendered harmless after deployment of the lower or drop plate and engagement of at least some of the spikes 32 with a tire, as will be explained later.

The latching means 22 is preferably connected to a known wireless control with a transmitter 42 in the driver's compartment of the vehicle and a receiver 44 connected to actuate the latching means 22. The transmitter 42 preferably is provided with means (not shown) to detachably mount it on the steering wheel (also not shown) of the police car where it can be readily actuated by the police officer driving the car. Thus the officer can concentrate on driving and actuate the invention without diverting attention from driving and the tactical situation occurring immediately behind the police vehicle. The transmitter 42 preferably is equipped with two buttons (not shown) for arming and actuating, respectively, the subject invention thereby avoiding accidental deployment of the spike carrying lower or drop plate 24 onto the roadway.

Figure 1:
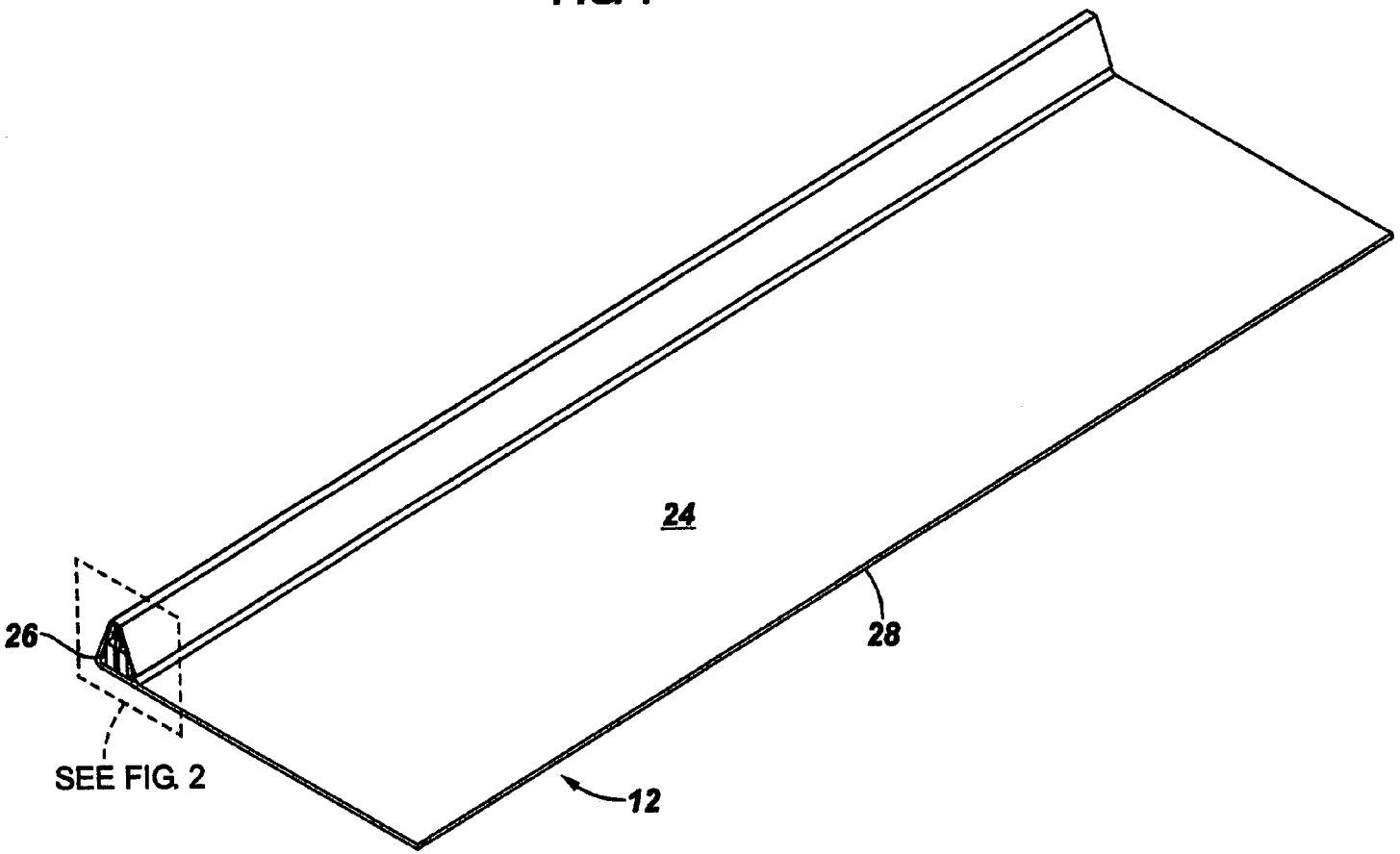
FIG. 1 is a perspective view of the lower or drop plate of the subject invention.

As shown, the lower plate 24 has its leading edge resting on the flange 16 and is held in place by the latching means 22. The spikes 32, of the present invention, are freely standing on the plate and are held in place by members 34, 36 and 38 and the trapezoidal shaped frangible section. To deploy the spikes 32, the latching means 22 is actuated to release the lower or drop plate 24. As this edge drops and engages the road surface, it causes the plate 24 to disengage from the flange 16 and drop to the road surface. The large area provided by the plate 24 will insure that the spikes will remain upright in proper position to engage the tires of the trailing or target vehicle. At least one tire of the target vehicle (going from left to right in FIGS. 1 and 2) will run over and shatter the trapezoidal section 26 enabling at least one hollow spike 32 to penetrate and deflate the tire. As the trapezoidal section 26 collapses, the members 34 and 36 will release the remaining spikes 32 and the member 38 will cause those spikes 32 to topple over to a harmless position.

Figure 2:
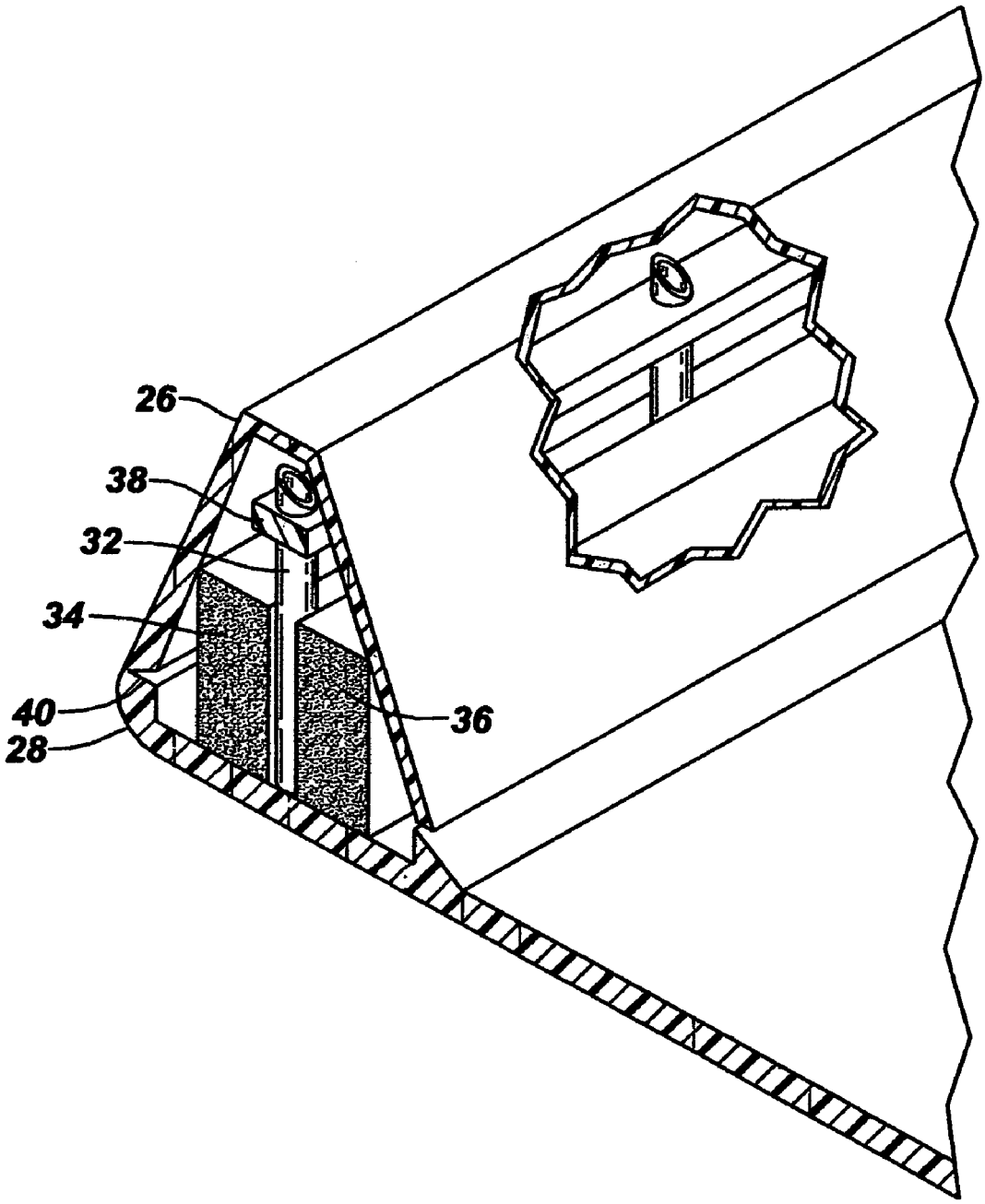
FIG. 2 is an enlarged, detail perspective view, partially in section and partially broken away, the lower or drop plate of the subject invention.
Figure 3:
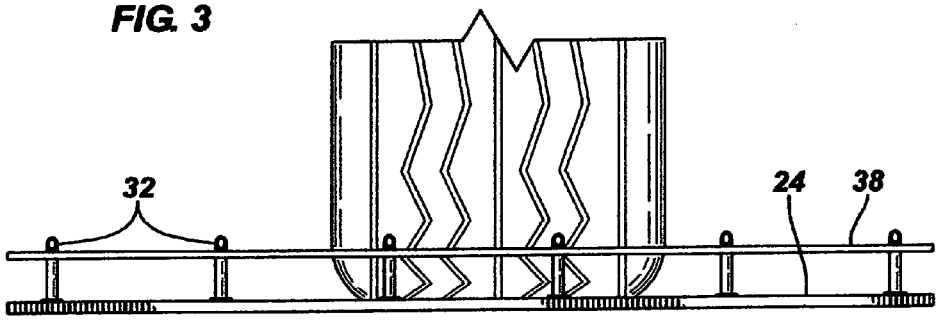
FIG. 3 is a diagrammatic transverse view showing the spikes of the subject invention about to be engaged by a tire.
Figure 4:
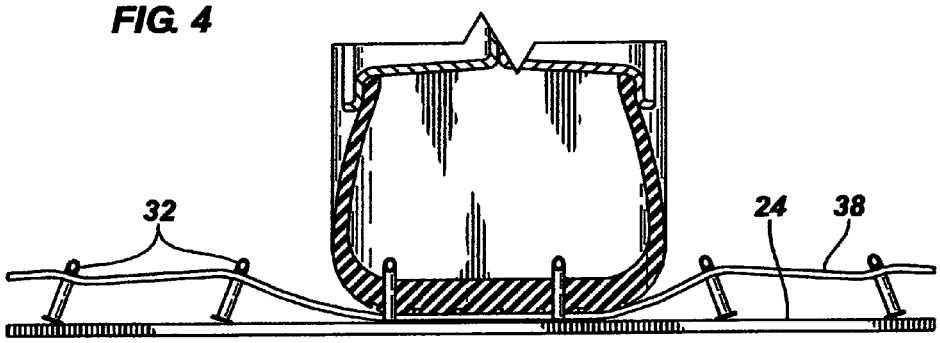
FIG. 4 is a view, similar to FIG. 3, showing the spikes of the subject invention engaging in a tire.
Figure 5:
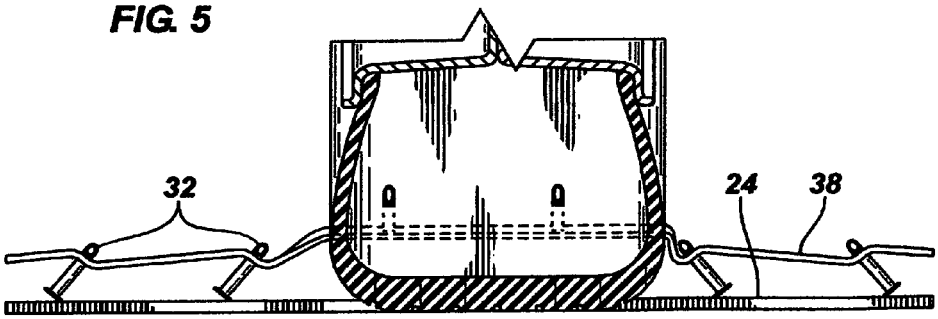
FIG. 5 is a view, similar to FIGS. 3 and 4, showing a tire leaving the bottom or drop plate of the subject invention.

A typical spike, according to the present invention, is best seen in FIG. 2. The spike 34 has a first end freely resting on the base plate and a second sharpened end projecting upwardly therefrom. The spike is actually a hollow tube and will be carried into the tire which will grip the spike pulling it from the base and provide means for rapidly deflating the tire.

The latching means 24 may be selected from any number of mechanical and/or electro mechanical latching devices. For example, there are many known latching devices currently available in the auto industry used for trunk releases, gas cap access releases, and hood releases. It may be preferred to have a totally mechanical release to avoid the unintended deploying of the spiked strip and/or to act as backup for an electromechanical release means.

The present invention may be subject to many modifications and changes without departing from the spirit or essential characteristics thereof. The present embodiment should therefor be considered in all respects as illustrative and not restrictive of the scope to the invention as defined by the appended claims.

I claim:

1. An apparatus mounted on a leading vehicle to cause deflation of the tires of a trailing vehicle, comprising:

a housing assembly mounted on a lower rear portion of said leading vehicle and defining a cavity therein, a drop plate forming a bottom of said housing being releasable from the rest of the housing;

release means for releasing said plate from said housing to be deposited on a road surface substantially immediately in front of said trailing vehicle;

a plurality of tire piercing spikes held by said plate, said drop plate having a frangible portion extending the length thereof and enclosing said plurality of spikes, stabilizing means within said frangible portion holding said plurality of spikes normal to the surface of said plate whereby, when a tire of said trailing vehicle crosses said frangible portion, it shatters allowing at least some of said spike to pierce said tire and releasing the remaining spikes to topple over into a harmless state, resilient means engaging the free ends os of said spikes whereby when at least one of said spikes is pulled by said tire the remaining spikes are pulled over to a harmless position.

2. An apparatus according to claim 1 wherein said housing comprises;

an upper plate mounted to a lower rear portion of said lead vehicle;

a first flange depending from a leading edge of said plate and terminating in a rearwardly directed lip;

said release means mounted on a rearward portion of said upper plate;

said drop plate having a lead edge for resting on said lip and a trailing edge engaged by said release means to hold said drop plate in assembly with said upper plate.

3. An apparatus according to claim 1 wherein said release mechanism is electromechanical and includes:

a transmitter accessible to the driver of the leading vehicle and having arm and actuate functions; and a receiver connected to said release means and responsive to said transmitter.

4. An apparatus according to claim 1 wherein said release means is mechanical.

5. A method to cause the deflation of the tires of a trailing vehicle from a leading vehicle comprising the steps of:

providing said lead vehicle with a housing assembly to be mounted beneath the rear portion of a vehicle, a drop plate forming the bottom of said housing;

providing a plurality of spikes held in an upright position by a frangible portion of said drop plate;

providing means to release said drop plate from said housing;

driving said leading vehicle to a position closely in front of said trailing vehicle;

releasing said drop plate from said housing assembly to fall on the road surface substantially immediately in front of said trailing vehicle which crushes the frangible portion of said drop plate whereby said spikes are exposed and at least one of said spikes penetrates and causes the deflation of at least one of the tires of said trailing vehicle while the remaining spikes are disabled.

6. A method according to claim 5 wherein said housing assembly comprises;

an upper plate mounted to a lower rear portion of said lead vehicle;

a first flange depending from a leading edge of said plate and terminating in a rearwardly directed lip;

said release means mounted on a rear portion of said upper plate;

said drop plate having a lead edge for resting on said lip and a trapezoidal shaped, spike containing trailing edge held against said upper plate by said release means.

7. A method according to claim 6 wherein said release mechanism is electro-mechanical and includes:

a transmitter accessible to the driver and having arm and actuate functions; and a receiver responsive to said transmitter and connected to actuate said release means.

8. A method according to claim 6 wherein said release means is mechanical.

9. A method according to claim 6 wherein:

said drop plate has a frangible portion extending the length thereof and enclosing said plurality of spikes.

10. A method according to claim 9 wherein drop plate further comprises:

stabilizer means within said frangible portion holding said plurality of spikes normal to the surface of said plate whereby, when a tire crosses said frangible portion, it shatters allowing at least some of said spike to pierce and deflate said tire and the remaining spikes are released to topple over into a harmless state.

11. A device for deflating the tires of a trailing vehicle from a lead vehicle, comprising:

housing means mounted on said lead vehicle, a drop plate forming a bottom of said housing, said drop plate having an elongated frangible portion of plastics material forming frangible edge of said drop plate, and means to release said drop plate from said housing;

a plurality of free standing spikes mounted on said base member enclosed within said formed frangible edge and held thereby to extend substantially normal to the plane of said drop plate, whereby when a tire of said trailing vehicle engages and crushes said frangible edge, at least one spike penetrates and deflates said tire while the remaining spikes are released to topple over to a non tire penetrating position.

12. A device apparatus according to claim 11 wherein said housing comprises;

a upper plate mounted to a lower rear portion of said lead vehicle;

a first flange depending from a leading edge of said plate and terminating in a rearwardly directed lip; and said release means mounted on a rearward portion of said upper plate to engage said drop plate forming the bottom of said housing.

13. A device according to claim 11 wherein said release mechanism is electro-mechanical and includes:

a transmitter accessible to the driver and having arm and actuate functions; and a receiver connected to said release means and responsive to said transmitter.

14. A device according to claim 11 wherein said release means is mechanical.

* * * * *